US005139737A

United States Patent [19]

Sudo et al.

[11] Patent Number: 5,139,737

[45] Date of Patent: Aug. 18, 1992

[54] STEEL FOR PLASTICS MOLDS SUPERIOR IN WELDABILITY

[75] Inventors: Koichi Sudo; Masaru Nagata, both of Nagoya, Japan

[73] Assignee: Dadio Tokushuko Kabushiki Kaisha, Nagoya, Japan

[21] Appl. No.: 622,567

[22] Filed: Dec. 5, 1990

[30] Foreign Application Priority Data

Dec. 6, 1989 [JP] Japan ..... 1-317147

[51] Int. Cl.[5] ..... C22C 38/22; C22C 38/60

[52] U.S. Cl. ..... 420/84; 420/111

[58] Field of Search ..... 420/84, 111

[56] References Cited

U.S. PATENT DOCUMENTS 4,333,776 6/1982 Bhattacharya et al. ..... 420/84

4,855,106 8/1989 Katsumata et al. ..... 420/111

FOREIGN PATENT DOCUMENTS 1286627 1/1962 France ..... 420/111

53-80318 7/1978 Japan ..... 420/111

61130457 6/1986 Japan ..... 420/111

*Primary Examiner*—Deborah Yee

*Attorney, Agent, or Firm*—Armstrong, Nikaido, Marmelstein, Kubovcik & Murray

[57] ABSTRACT

Disclosed is a steel for plastics molds superior in weldability. The steel consists essentially of C: 0.1 to 0.3%, Mn: 0.5 to 3.5%, Cr: 1.0 to 3.0%, Mo:0.03 to 2.0%, V:0.1 to 1.0% and S: 0.01 to 0.10%; Si: not more than 0.25%, P: not more than 0.2%, and B: not more than 0.002%; the balance being substantially Fe. The alloy composition should satisfy the following formula:

$$BH=326.0+847.3\,(C\%)+18.3\,(Si\%)-8.6\,(Mn\%)-12.5\,(Cr\%)\leqq 460$$

The steel can be welded in the process of manufacturing a plastics mold without reqiring preheating and post-heating.

12 Claims, 7 Drawing Sheets

STEEL FOR PLASTICS MOLDS SUPERIOR IN WELDABILITY

BACKGROUND OF THE INVENTION

1. Field of the Invention

This invention relates to an improvement of a prehardened steel used for manufacturing plastics molds.

2. State of the Art

To date general structural steels (for example, S55C) and medium or low carbon steels (typically, SCM445) have been used as the material for manufacturing plastics molds, particularly injection molds, to produce relatively large-sized moldings.

In a mold fabrication for which these materials are used, the circumstances are such that a mold on the way to fabrication must be repaired, so often, through build-up welding due to working errors or a design changes. For welding repair, a preheating (250° to 350° C.), and further a postheating, as occasion demands, will be necessary for prevention of weld crack.

However, the problem is that an exclusive heating furnace will be prepared preferably for ensuring a uniform heating and that the larger a mold is, the longer the time is required, and a welding work for the pieces of high temperature involves, as a matter of course, a lowered working efficiency. Weld cracks are quite unavoidable from carrying out welding on the insufficiently preheated molds, which are no more to attain the purpose, and there may be a case, still worse, where an excessive crack is caused thereon to necessitate refabrication consequently.

Besides, the steel for plastics molds must be ready for hardening, uniform in hardness at every sections, less in segregation and superior in both mirror finishing and crimping workability, and also satisfactory in machinability.

SUMMARY OF THE INVENTION

In solving the aforementioned problems, the object of this invention is to provide a steel for plastics molds superior in welding repair efficiency and free from causing a weld crack from carrying out build-up welding without preheating and postheating as keeping or enhancing properties of the material currently employed.

A steel for plastics molds according to this invention which is superior in weldability without requiring preheating and postheating basically consists of C: 0.1 to 0.3%, Mn: 0.5 to 3.5%, Cr: 1.0 to 3.0%, Mo: 0.03 to 2.0%, V: 0.01 to 1.0% and S: 0.01 to 0.10%; Si: not more than 0.25%, P: not more than 0.02% and B: not more than 0.002%; the balance being substantially in Fe; and the alloy composition satisfying the following formula:

$$BH=326.0+847.3\,(C\%)+18.3\,(Si\%)-8.6\,(Mn\%)-12.5\,(Cr\%)\leqq 460.$$

Further to the aforementioned alloy composition, Ni will be added at 2.0% or less, thereby enhancing a hardening efficiency. Furthermore, one or more of Zr: 0.003 to 0.2%, Pb: 0.03 to 0.20%, Te: 0.01 to 0.15%, Ca: 0.005 to 0.010% and Bi: 0.01 to 0.20% will be added to the aforementioned basic composition, thereby enhancing the machinability. Needless to say, Ni and the free-cutting element or elements may be used at the same time.

BRIEF DESCRIPTION OF THE DRAWINGS

All the drawings show the graphs of the test data on this invention:

FIG. 7 and FIG. 8 represent machinability of the steels of this invention as compared with a conventional steel, wherein FIG. 7 represents the case of end mill cutting, and FIG. 8 represents the case of drill cutting:

DETAILED EXPLANATION OF PREFERRED EMBODIMENTS

Figure 1:
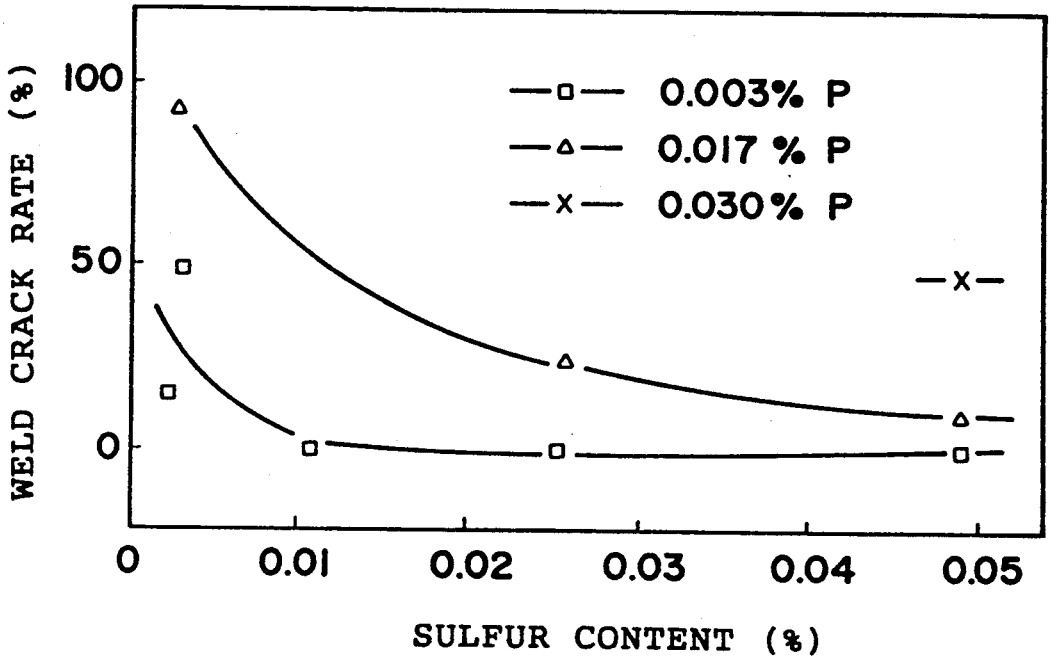
FIG. 1 indicates an influence exerted on weld crack susceptibility by P-and S-contents in the steels.

It is not easy to ensure a hardening efficiency enough to secure HRC 30 to 33 on a material for the molds such large-sized as 500×1,000 mm in section, and also to reduce the susceptibility to weld crack.

In the past, when a "weld crack susceptibility index", Pc, of a steel for molds is expressed with reference to an alloy composition by the following formula:

$$Pc=C+Si/30+Mn/20+Cr/20+Ni/60+Cr/20+Mo/15+V/10+50+H/60+t/600\ (\%)$$

a minimum preheating temperature for preventing a weld crack thoroughly rises according to an increase of Pc value, and for dropping it to an ordinary temperature or around, that is, for committing a preheating, a condition Pc 0.30 must be satisfied, which was so reported (Ito et al "Journal of Welding Engineers Association" 37 (1968) 9) and acknowledged generally.

In a prehardened steel having a hardness exceeding HRC 30, a high temperature tempering will be premised in view of a residual stress removal, and for securing a sufficient hardening efficiency in consideration of mass effect, elements for enhancing the hardenability such as Mn, Cr, Mo, V and the like must be added thereto, therefore the Pc value usually breaks through the aforementioned limit, 0.3. Accordingly, a preheating at 300° C. or around was necessary in the past as mentioned above.

To remove such a drawback, the inventions have taken the alloy components into reexamination and found that from reducing a content of Si and controlling impurities, P and B, and further allowing a proper quantity of S to exist, an addition limit of the hardenability enhancing elements will be heightened, and even in a domain where the Pc value exceeds 0.3, a preheating a advance to welding can be omitted.

In furthering the research, it has been found that the limit for the weld crack to arise may be decided practically by the BH value expressed by the foregoing formula rather than the Pc value, and particularly, if a hardness on a base metal side in the vicinity of a weld interface satisfies this condition, then the weld interface satisfies this condition, then the weld crack can securely be prevented. A description will refer in detail to this respect hereinlater.

In the steel for plastics molds of this invention which has been accomplished as described above, the effects of each alloy element and the reason why the composition ranges are thus limited are as given below:

C: 0.1 to 0.3%

C provides hardness. When tempered at 600° C. or higher to remove residual stress after heat treatment, C must be present at 0.1% or more for obtaining a necessary hardness HRC 28 or higher. On the other hand, C-content must not exceed 0.3% so as to reduce a weld crack susceptibility.

Mn: 0.5 to 3.5%

Mn is added for securing hardenability other than functioning as a deoxidizer at the time of refining. Then, it is effective for suppressing weld crack by lowering the hardness of the base metal at the time of welding. A content coming less than 0.5% is not to ensure the effects. If exceeding 3.5%, the machinability will be low and the steel becomes improper for mold fabrication.

Cr: 1.0 to 3.0%

A content of Cr not less than 1.0% is required for securing hardenability of large-sized molds. However, if it exceeds 3%, then Bainite transformation curve shifts to the long time side and an intended Bainite structure will not be obtainable, thus the machinability deteriorates. Disadvantages economically, too.

Mo: 0.03 to 2.0%

Mo functions also for enhancing hardenability of large-sized molds and for securing a hardness at HRC 28 or higher by providing tempering softening resistance at 600° C. or higher. At such small quantity as 0.03% Mo is still effective. If contained much, then a machinability deteriorates and a high cost may result, therefore it is added up to 2.0% and no more.

V: 0.01 to 1.0%

V is effective highly on enhancing a tempering softening resistance. Addition at 0.01% or more is available for securing a hardness at HRC 28 or higher. It is also effective on fining down crystal grains. Addition at 0.01% or more is effective, however, if added excessively on the other hand, machinability and stiffness may deteriorate, therefore, it is added selectively within 1.0%.

S: 0.01 to 0.10%

Existence of S at 0.01% or more is effective on prevention of weld crack. Existence of S in some quantity is preferable also for machinability. However, addition exceeding 0.1% is ready for causing weld crack (so-called "lamellar tier") due to existence of the sulfides and deteriorating stiffness. With respect to the crimping and mirror finishing, addition of a smaller quantity is preferable.

The reason why the contents of Si, P and B are controlled is as follows:

Si: not more than 0.25%

While Si is useful from the viewpoint of deoxidation effect and hardening efficiency at the time of producing the steel, it is to be controlled as little as possible for lowering a weld crack susceptibility. It is preferable that the content be also reduced for lightening the segregation and enhancing crimping workability. The content 0.25% is a tolerance limit.

P: not more than 0.02%; B: not more than 0.002%

Both the elements are harmful to weld crack susceptibility, and hence are to be removed to the utmost. The aforementioned numerals are defined as the tolerance limits both.

Functions of the arbitrary additive elements and the reason why the contents thereof are limited are as follows:

Ni: not more than 2.0%

As described hereinbefore, addition of Ni may contribute to enhancement of hardenability. If the content exceeds the upper limit, the machinability deteriorates.

Zr: 0.003 to 0.2%, Pb: 0.03 to 0.2%, Te: 0.01 to 0.15%, Ca: 0.0005 to 0.010%, Bi: 0.01 to 0.2%

These are all free-cutting elements. Above all, Zr functions to control elongation of sulfides and thus to enhance the stiffness, however, if the content exceeds 0.2%, then the machinability rather deteriorates. The other elements are restricted for occurrence of ground flaw and black spot, and the upper limits are determined each accordingly.

The steel for plastics molds according to this invention is ready for repairing through welding work at ordinary temperature without requiring preheating and postheating, and there is no substantial risk of cracks in the weld zone. With a satisfactory hardening efficiency, even a large-sized material has a uniform distribution of hardness in sections, and thus a mold with less strain is obtainable even from die-milling straight a block supplied as a prehardened steel of HRC30 class (not less than 28). Because of less segregation, crimping workability is satisfactory, and unevenness of grinding is almost not resultant, too. The machinability is superior to a prior art SCM445 steel (HRC27 or so).

Accordingly, the steel for molds is preferable as a material intended for manufacturing large-sized plastics such as automobile panel, bumper, TV cabinet, bathtub and the like.

EXAMPLES

The history wherein this invention was achieved will be described with reference to the experimental data, and the ground whereby the aforementioned composition has been selected will be indicated.

First, three kinds of steels of the compositions given in Table 1 were prepared, and the ingots thereof were subjected to a heat treatment after forging, thus preparing test pieces. Welding was carried out thereon according to "Diagonal Y-type Weld Crack Test Method" specified by JIS Z-3158, and the weld zones were cut to see how cracks stand.

TABLE 1

| | | | |
|---|---|---|---|
| C: | 0.20 | S: | 0.002 to 0.049 |
| Si: | 0.06 | Cr: | 2.5 |
| Mn: | 1.0 | Mo: | 0.4 |
| P: | 0.003 to 0.017 | V: | 0.1 |
| | | (wt. %, balance: Fe) | |

A graph of FIG. 1 was obtained from plotting influence of P-content and S-content exerted on the weld crack rate. As a result, it is understood that P must be retained as little as possible, or not more than 0.02% Practically, and on the other hand, S must be present not less than 0.01%.

In the case of "PDS3" steel (SCM445 steel being improved by Daido Tokushuko K.K.) subjected to the same test for comparison, a 100% crack was resultant on the weld zone.

Then, the steels of the composition given in Table 2 were prepared and subjected to the welding test the same as above to see how C and Si contents would influence on the weld crack susceptibility with P and S contents kept almost constant.

TABLE 2

| | | | |
|---|---|---|---|
| C: | 0.15 to 0.20 | S: | 0.026 |
| Si: | 0.05 to 0.9 | Cr: | 2.5 |
| Mn: | 1.0 | Mo: | 0.4 |
| P: | 0.003 | V: | 0.1 |
| | | (wt. %, balance: Fe) | |

Figure 2:
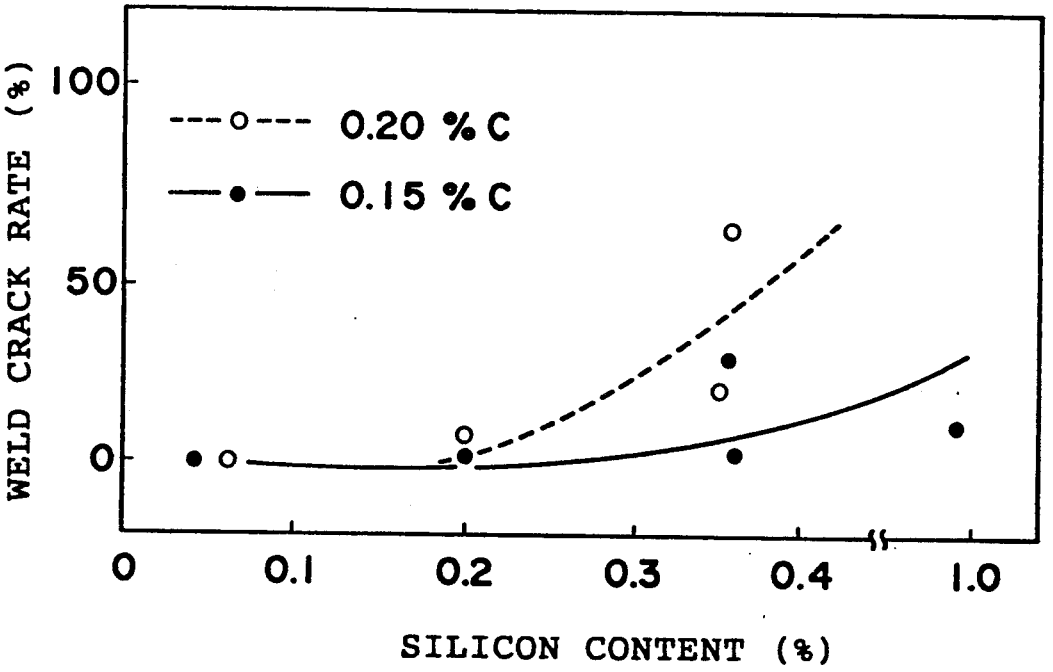
FIG. 2 indicates an influence exerted on weld crack susceptibility by Si-content in the steels.

A graph indicating the weld crack rate is as shown in FIG. 2. From the result, it is understood that Si must be 0.2% or less for the component given in Table 2, and a limit of the Si content rises in the case of low-C steel. However, in consideration of the segregation being capable of impairing a crimping workability, the upper bound was specified at 0.25%.

Subsequently, to determine C-, Cr- and Mn-contents which exert an influence upon the weld crack susceptibility and hardening efficiency, the steels of the composition of Table 3 were prepared and subjected to the same welding test.

TABLE 3

| | | | |
|---|---|---|---|
| C: | 0.10 to 0.20 | S: | 0.026 |
| Si: | 0.05 to 0.15 | Cr: | 1.5 to 2.5 |
| Mn: | 0.5 to 1.5 | Mo: | 0.4 |
| P: | 0.003 | V: | 0.1 |
| | | (wt. %, balance: Fe) | |

Figure 3:
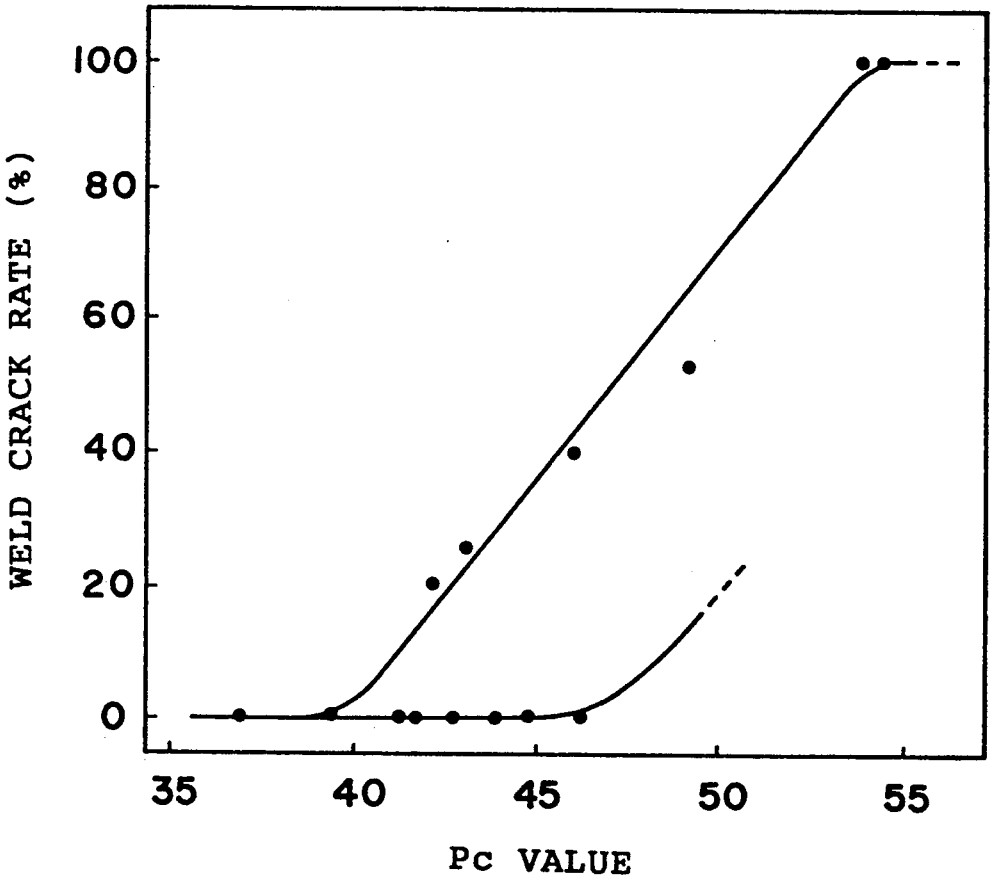
FIG. 3 is that in which the relation between a Pc value of steel and a weld crack rate is plotted.

The results obtained from calculating Pc values of each sample and plotting the relation with the weld crack rate are as shown in FIG. 3. From the graph, it is understood that weld crack can substantially be avoided even from setting the Pc value at 0.4 or so exceeding 0.3 which is a limit specified hitherto. This is so realized by lowering-content Si and regulating P-content, and employing an appropriate S-content, however, since the Pc value has a width in limits it is taken not so proper as a method for adjustment.

Figure 4:
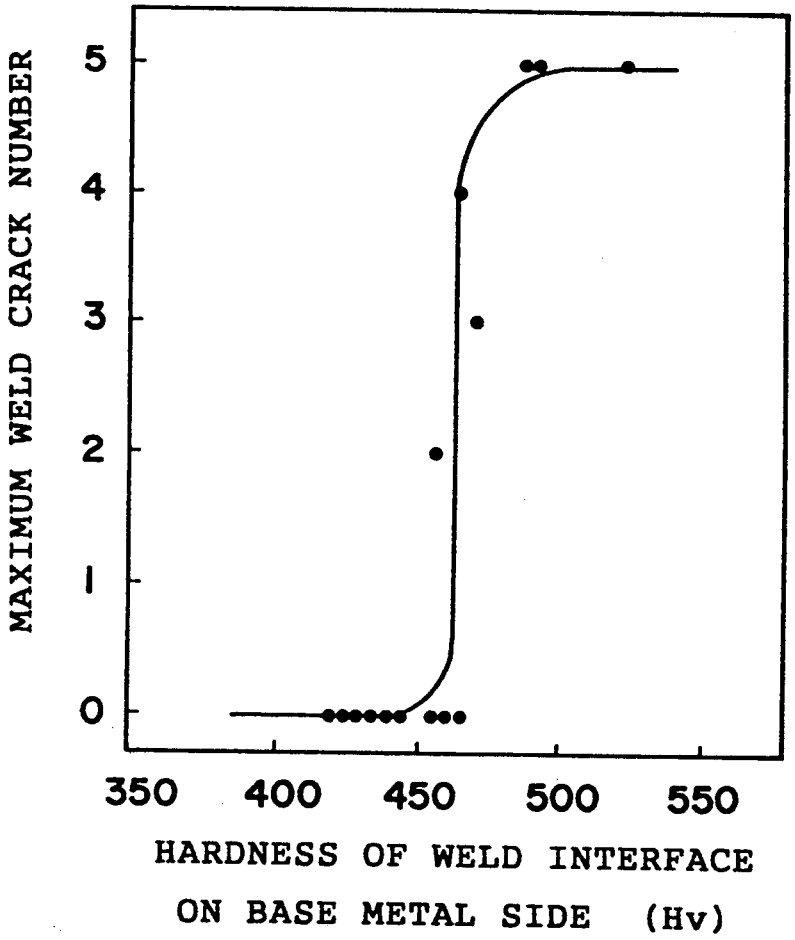
FIG. 4 is that in which the relation between a hardness of a weld interface on a base metal side and a maximum weld crack number is plotted.
Figure 5:
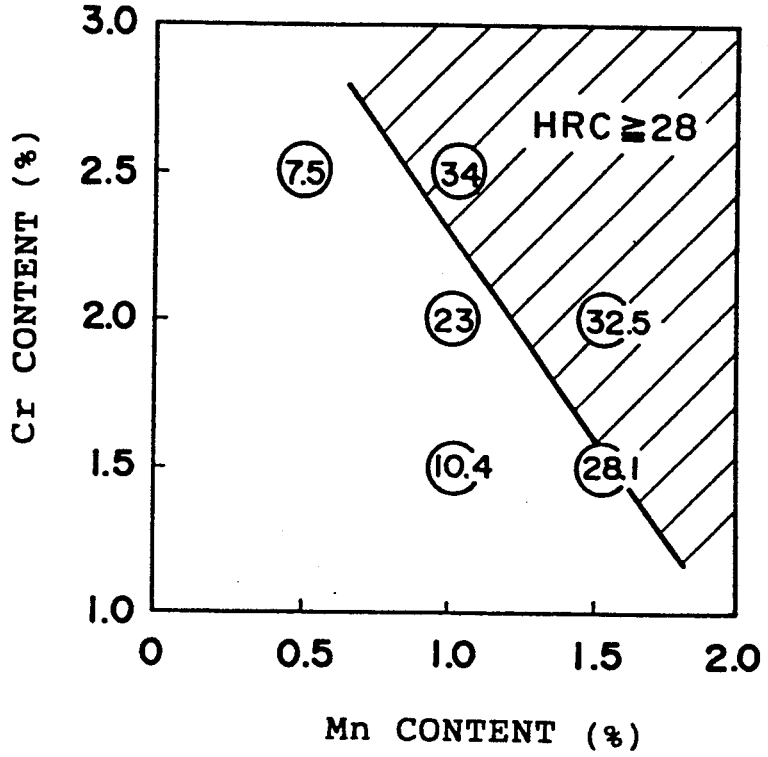
FIG. 5 refers to data of hardening efficiency when Mn-and Cr-contents are changed in the steels of this invention.

Now, therefore, every conceivable means was taken up for examination to regard a maximum crack number as the weld crack susceptibility instead of the weld crack rate and shape it with the hardness on a base metal side of the weld interface where a maximum stress is applied, thereby obtaining a graph of FIG. 4. In the graph, the weld crack rate sharply increases at the boundary of 460 in Hv of the hardness BH on a base metal side of the weld interface. Therefore, an alloy composition to provide a weld zone whereat the BH value does not reach 460 may be employed.

As a result of having carried out a regression analysis on the aforementioned data with reference to the relation between the BH value and the alloy composition, the above-mentioned equation, that is:

$$BH=326.0+847.3\,(C\%)+18.3\,(Si\%)-8.6\,(Mn\%)-12.5\,(Cr\%)$$

(Coefficient of correlation: 0.9870; factor of contribution: 0.9741) was obtained. Here, what is notable is that coefficients of Mn and Cr are minus.

Further, for examining C-, Cr- and Mn-contents from an aspect of hardening efficiency, when a material 500 mm high and 1,000 mm wide in section was settled and cooled down, hardening and tempering were carried out as simulating a cooling curve at the central portion, as:

Hardening Conditions
- heated up to 970° C. for 30 minutes
- cooled down to 600° C. at a rate 2.5° C./min.
- cooled down to ordinary temperature thereafter with the cooling rate reduced by half Tempering Conditions
- heated at 600° C. for 60 minutes
- air-cooled with reference to a steel of the composition coming in (0.15/0.20)C−0.06Si−(0.5/1.0/1.5)Mn−(1.5/2.0/2.5)-Cr representing the case of 0.20%C, and the domain where HRC is 28 or higher comes on the right side of a line running from left to right downward.

Figure 6:
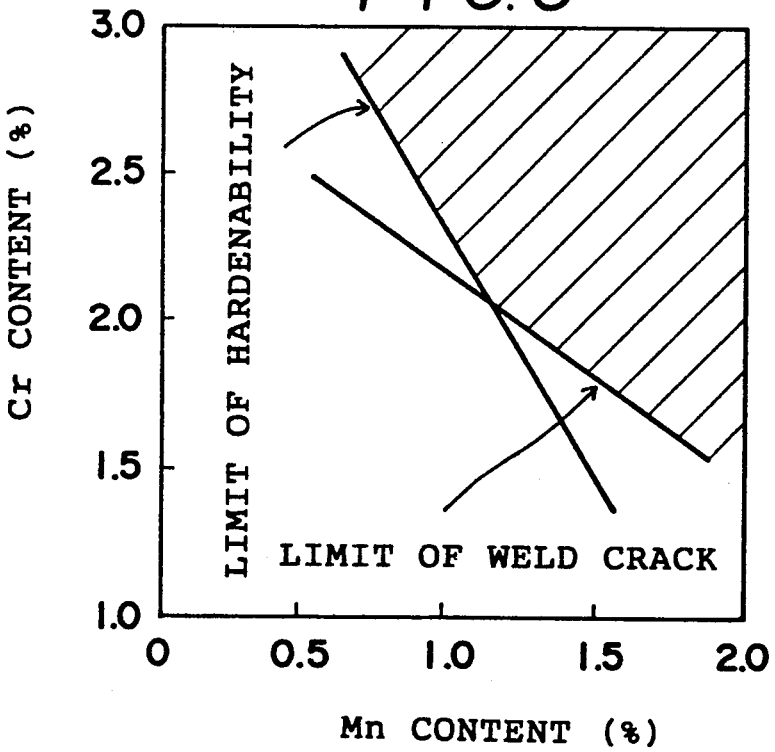
FIG. 6 represents that for which the limit of weld crack is combined with the limit of hardening efficiency obtained from the data of FIG. 5.

On the other hand, in regard to the weld crack, it is necessary that Cr and Mn be contained not less than a certain limit as will be understood from the aforementioned equation of BH value. From combining this with the aforementioned limit on hardening efficiency, the domain is as indicated by oblique lines in FIG. 6 in the case of 0.20%C. Further, in the case of 0.15%C, when HRC becomes or higher, a weld crack is not produced within the limit for providing a hardening efficiency.

Working Example 1

The alloy composition with a predetermined hardening efficiency and a low weld crack susceptibility was determined as described above, therefore, steels coming within the range of composition were tested and ensured for machinability. That is, steels of the composition shown in Table 4 were prepared, and the ingots were forged to 360 mm high ×810 mm wide ×2,000 mm long, and then hardened and tempered.

In Table 4, samples No. 1 and No. 2 are steels according to this invention, and No. 3 is a conventional SCM 445 steel. For hardening, No. 1 and No. 2 were heated at 970° C., No. 3 was heated at 870° C., all were subjected to an air blast cooling, and all were tempered at 600° C.

TABLE 4

| | No. 1 | No. 2 | No. 3 |
|---|---|---|---|
| C | 0.18 | 0.17 | 0.40 |
| Si | 0.040 | 0.035 | 0.24 |
| Mn | 1.01 | 1.49 | 0.24 |
| P | 0.006 | 0.006 | 0.018 |
| S | 0.027 | 0.025 | 0.025 |
| Ni | 0.03 | 0.03 | 0.17 |
| Cr | 2.51 | 2.00 | 1.26 |
| Mo | 0.40 | 0.39 | 0.34 |
| V | 0.11 | 0.11 | — |
| B | — | — | — |

As for hardness HRC after heat treatment, No. 1 and No. 2 stood both at 32, and No. 3 at 27.5. Both steels of this invention were of Bainite in structure, of which No. 1 had some ferrite mixed therein, and No. 3 was a ferrite/pearlite structure. The machinability was examined according to the following conditions:

End Mill Cutting Test
- End mill: 10 mm diameter;
- Cutting width: 10 mm
- Depth of cut: 5 mm
- Cutting oil: Yucilone No. 3

Figure 7:
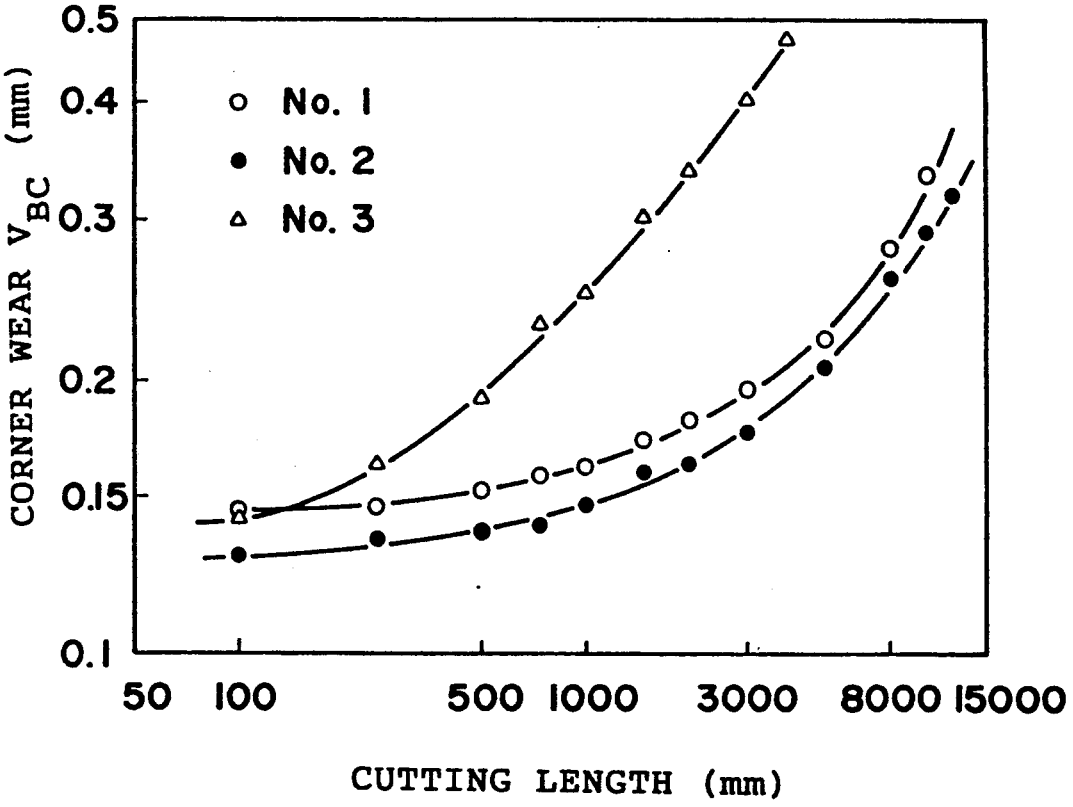
Figure 8:
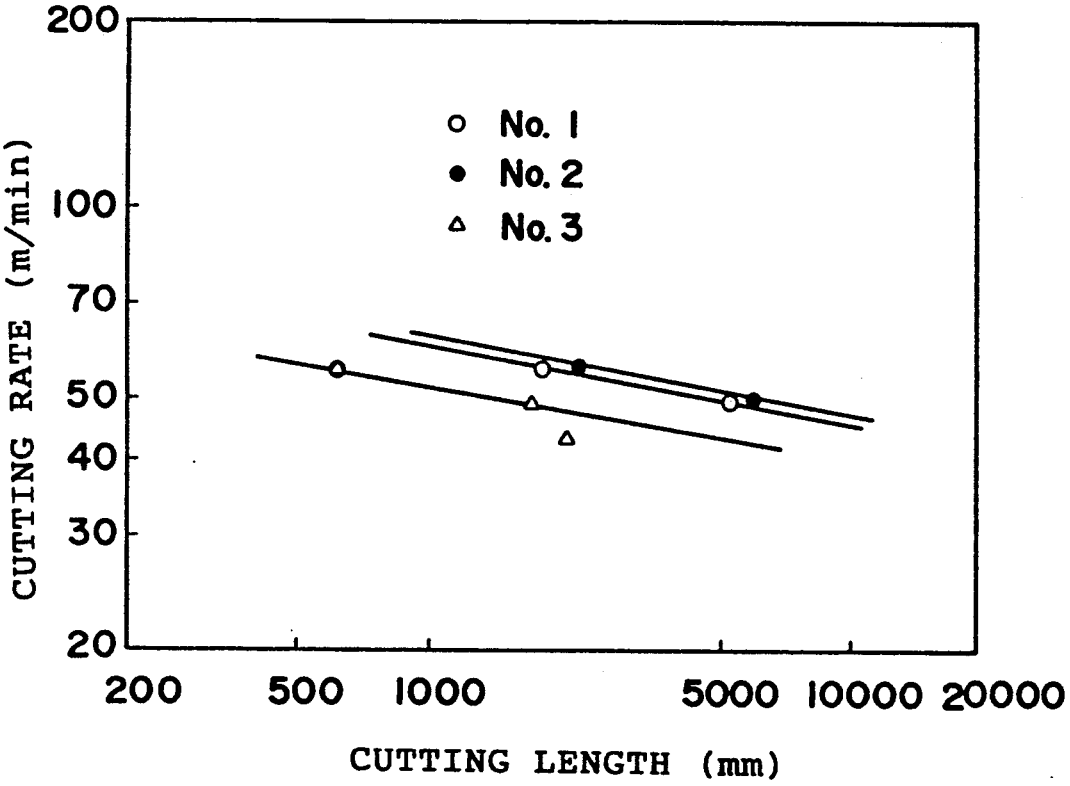

Drill Cutting Test
- Drill: 5 mm diameter, SKH51
- Hole of cut: blind hole 15 mm Cutting oil:

The results were as shown in FIG. 7 (end mill cutting) and FIG. 8 (drill cutting). The difference in the structure may be the reason why the steels of this invention are superior in machinability despite being high in hardness as compared with a conventional steel.

Figure 9:
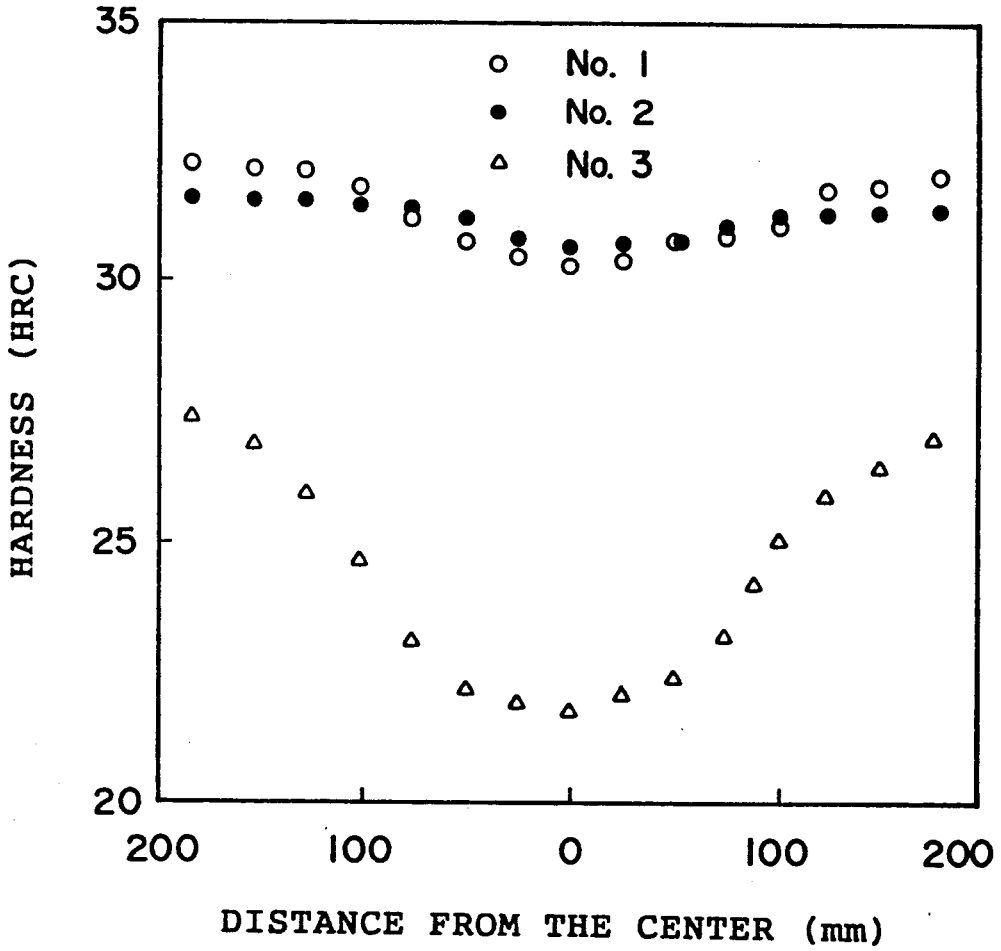
FIG. 9 represents distribution of hardness in the 0 materials of large section as compared with a conventional steel.

To examine the uniformity of hardness distribution at sections of the steels No. 2 and No. 3 above, materials 360 mm high, 810 mm wide and 2,000 mm long each were cut at the center, and the hardness at points covering the upper and lower surfaces from the centers was measured. The results obtained by plotting the data are as shown in FIG. 9. While a width of the hardness HRC reaches 5 to 6 in the case of the prior art steel, it is kept within 2 in the steels of this invention. The difference indicates that a mass effect of the steels of this invention is small.

In regard to the weld crack resistance which is the most important, blocks 240 mm high, 400 mm wide and 600 mm long each were cut out of the materials No. 1 to No. 3 above, build-up welding on the upper surface (bead A) and build-up welding on the end surface (bead B) were carried out through TIG welding using DS250 (0.14C−0.72Si−2.2Mn−1.1Cr−0.5Mo) as the welding material both. Conditions on how the weld crack was produced were examined with reference to the bead A left as welded, and ground up to the surface and to 0.5 mm and 1.0 mm in depth each on a grinder, and also with reference to the bead B left as welded, and ground up to the surface on a grinder. In the welding carried out to the steel of comparative example, cracks occurred under and at the end on the beads in both cases mentioned above, while no crack was totally observed in the steels of this invention.

Working Example 2

Steels of the composition shown in Table 5 were prepared. No. 21 in the comparative example is conventional SCM445 steel. After forging, the following heat treatment was applied:

(Hardening) 870 to 1,030° C.; air-cooled (Tempering) 600 to 650° C.

Each sample was subjected to measurement of hardness at the section center line 400 mm thick and 900 mm wide. Values at the surface layer and the center are shown in Table 6.

As to the weld crack, a crack rate (%) was recorded through the diagonal Y-type weld crack test specified in JIS Z-3158 as mentioned above. For workability, drill cutting (aforementioned conditions), mirror finishing (finish grade #3000) and crimping were carried out thereon, and appreciation was made by the ratio of time required for working as compared with the conventional SCM445 steel. (Accordingly, the smaller the numerical value is, the better the result becomes.) Those results are also included in Table 6. A satisfactory crimping workability of the steels of this invention may be so ensured by a decrease of segregation according to lowered Si-content and P-content employed by this invention.

TABLE 5

| Classification | No. | Alloy Composition (wt. %, balance Fe) | | | | | | | | | | | |
|---|---|---|---|---|---|---|---|---|---|---|---|---|---|
| | | C | Si | Mn | Cr | Mo | V | P | S | B | Ni | Ca, Pb, Zr, Te | BH |
| Working example | 11 | 0.14 | 0.17 | 1.62 | 2.03 | 0.48 | 0.20 | 0.012 | 0.025 | 0.0005 | — | — | 408 |
| | 12 | 0.22 | 0.05 | 2.78 | 2.74 | 0.71 | 0.11 | 0.010 | 0.035 | 0.0009 | — | — | 455 |
| | 13 | 0.19 | 0.10 | 1.78 | 1.85 | 0.38 | 0.15 | 0.008 | 0.029 | 0.0004 | — | — | 450 |
| | 14 | 0.18 | 0.09 | 0.97 | 2.71 | 0.13 | 0.50 | 0.009 | 0.056 | 0.0011 | 1.01 | — | 436 |
| | 15 | 0.15 | 0.23 | 2.33 | 1.58 | 1.12 | 0.61 | 0.012 | 0.061 | 0.0061 | 0.85 | — | 418 |
| | 16 | 0.20 | 0.06 | 1.53 | 2.05 | 0.39 | 0.15 | 0.009 | 0.063 | 0.0012 | — | Pb 0.14 | 458 |
| | 17 | 0.23 | 0.02 | 3.42 | 2.90 | 0.64 | 0.18 | 0.009 | 0.051 | 0.0008 | — | Zr 0.016 | 456 |
| | 18 | 0.17 | 0.09 | 2.15 | 1.45 | 1.08 | 0.55 | 0.006 | 0.031 | 0.0007 | — | Ca 0.015, Pb 0.11, Zr 0.05, Te 0.03 | 435 |
| | 19 | 0.15 | 0.23 | 1.79 | 2.66 | 0.96 | 0.25 | 0.009 | 0.071 | 0.0011 | 1.30 | Ca 0.0020 | 409 |
| | 20 | 0.19 | 0.12 | 1.08 | 2.83 | 0.43 | 0.09 | 0.006 | 0.066 | 0.0013 | 1.11 | Ca 0.0015, Pb 0.11, | 445 |
| Comparative example | 21 | 0.45 | 0.26 | 0.93 | 1.21 | 0.37 | — | 0.025 | 0.027 | — | — | — | 689 |
| | 22 | 0.18 | 0.08 | 1.46 | 2.11 | 0.44 | 0.15 | 0.005 | 0.008 | 0.0006 | 0.03 | — | 441 |
| | 23 | 0.14 | 0.10 | 1.03 | 2.62 | 1.31 | 0.22 | 0.008 | 0.036 | 0.0028 | — | — | 405 |
| | 24 | 0.25 | 0.22 | 1.13 | 1.54 | 0.96 | 0.53 | 0.007 | 0.045 | 0.0011 | — | — | 513 |
| | 25 | 0.38 | 0.41 | 0.98 | 2.01 | 0.52 | 0.15 | 0.008 | 0.056 | 0.0008 | — | — | 622 |
| | 26 | 0.19 | 0.06 | 1.10 | 2.45 | 0.41 | 0.10 | 0.025 | 0.025 | 0.0004 | — | — | 448 |
| | 27 | 0.18 | 0.37 | 1.96 | 1.98 | 0.84 | 0.21 | 0.005 | 0.033 | 0.0005 | — | — | 444 |

TABLE 6

| Classification | No. | Hardness (HRC) | | Weld crack rate | Workability | | |
|---|---|---|---|---|---|---|---|
| | | Surface layer | Center | (%) | Cutting | Mirror finishing | Crimping |
| Working example | 11 | 29.5 | 28.0 | 0 | 0.70 | 0.85 | 0.60 |
| | 12 | 32.1 | 30.0 | 0 | 0.83 | 0.77 | 0.48 |
| | 13 | 31.1 | 28.8 | 0 | 0.82 | 0.76 | 0.53 |
| | 14 | 31.2 | 29.1 | 0 | 0.75 | 0.80 | 0.50 |
| | 15 | 29.7 | 28.2 | 0 | 0.75 | 0.83 | 0.75 |
| | 16 | 30.9 | 29.0 | 0 | 0.53 | 0.60 | 0.51 |
| | 17 | 32.5 | 30.8 | 0 | 0.85 | 0.45 | 0.70 |
| | 18 | 29.9 | 29.0 | 0 | 0.31 | 0.85 | 0.88 |
| | 19 | 29.5 | 29.0 | 0 | 0.79 | 0.75 | 0.73 |
| | 20 | 32.0 | 31.1 | 0 | 0.48 | 0.80 | 0.83 |
| Comparative example | 21 | 27.6 | 19.2 | 100 | 1.00 | 1.00 | 1.00 |
| | 22 | 31.0 | 28.5 | 35 | 1.01 | 0.55 | 0.81 |
| | 23 | 27.8 | 27.1 | 80 | 0.74 | 0.83 | 0.95 |
| | 24 | 28.0 | 26.5 | 95 | 0.81 | 0.95 | 0.90 |
| | 25 | 29.2 | 27.3 | 100 | 0.90 | 1.25 | 0.88 |
| | 26 | 33.1 | 30.5 | 40 | 0.75 | 0.48 | 0.77 |

TABLE 6-continued

| Classification | No. | Hardness (HRC) Surface layer | Hardness (HRC) Center | Weld crack rate (%) | Workability Cutting | Workability Mirror finishing | Workability Crimping |
|---|---|---|---|---|---|---|---|
| | 27 | 32.8 | 32.0 | 33 | 0.87 | 0.98 | 0.73 |

We claim:

1. A steel for plastics molds superior in weldability without requiring preheating and postheating, consisting essentially of C: 0.1 to 0.3%, Mn: 0.5 to 3.5%, Cr: 1.0 to 3.0%, Mo:0.03 to 2.0%, V:0.01 to 1.0% and S: 0.025 to 0.10%; Si: not more than 0.25%, P: not more than 0.02%, and B: not more than 0.002%; the balance being substantially Fe; and the alloy composition satisfying the following formula:

$$BH=326.0+847.3\,(C\%)+18.3\,(Si\%)-8.6\,(Mn\%)-12.5\,(Cr\%)\leqq 460.$$

2. A steel for plastics molds superior in weldability without requiring preheating and postheating, consisting essentially of C: 0.1 to 0.3%, Mn: 0.5 to 3.5%, Cr: 1.0 to 3.0%, Mo: 0.03 to 2.0%, V: 0.01 to 1.0%, S: 0.0025 to 0.10% and Ni: not more than 2.0% in addition thereto, Si: not more than 0.25%, P: not more than 0.02%, B: not more than 0.002%, the balance being substantially Fe; and the alloy composition satisfying the following formula:

$$BH=326.0+847.3\,(C\%)+18.3\,(Si\%)-8.6\,(Mn\%)-12.5\,(Cr\%)\leqq 460.$$

3. A steel for plastics molds superior in weldability without requiring preheating and postheating, consisting essentially of C: 0.1 to 0.3%, Mn: 0.5 to 3.5%, Cr: 1.0 to 3.0%, Mo: 0.03 to 2.0%, V: 0.01 to 1.0% and S: 0.01 to 0.10%; in addition thereto one or more of Zr: 0.003 to 0.2%, Pb: 0.03 to 0.20%, Te: 0.01 to 0.15%, Ca: 0.0005 to 0.010% and Bi: 0.01 to 0.20%; Si: not more than 0.25%, P: not more than 0.02%, B: not more than 0.002%; the balance being substantially Fe; and the alloy composition satisfying the following formula:

$$BH=326.0+847.3\,(C\%)+18.3\,(Si\%)-8.6\,(Mn\%)-12.5\,(Cr\%)\leqq 460.$$

4. A steel for plastics molds superior in weldability without requiring preheating and postheating, consisting essentially of C: 0.1 to 0.3%, Mn: 0.5 to 3.5%, Cr: 1.0 to 3.0%, Mo: 0.03 to 2.0%, V: 0.01 to 1.0% and S: 0.01 to 0.10%: in addition thereto Ni: up to 2.0%, and one or more of Zr: 0.003 to 0.20%, Pb: 0.03 to 0.20%, Te: 0.01 to 0.15%, Ca: 0.0005 to 0.010% and Bi: 0.01 to 0.20%; Si: not more than 0.25%, P: not more than 0.02%, B: not more than 0.002%; the balance being substantially Fe; and the alloy composition satisfying the following formula:

$$BH=326.0+847.3\,(C\%)+18.3\,(Si\%)-8.6\,(Mn\%)-12.5\,(Cr\%)\leqq 460.$$

5. A steel as defined in claim 1, wherein C is from 0.19 to 0.23%.

6. A steel as defined in claim 1, wherein Mn is from 1.49 to 3.42%.

7. A steel as defined in claim 1, wherein Mn is from 1.62 to 2.78%.

8. A steel as defined in claim 1, wherein V is from 0.55 to 0.61%.

9. A steel as defined in claim 1, wherein S is from 0.025 to 0.071%.

10. A steel as defined in claim 1, wherein P is from 0.010 to 0.012%.

11. A steel as defined in claim 1, wherein B is from 0.0004 to 0.0013%.

12. A steel as defined in claim 2, wherein Ni is from 0.03 to 1.3%.

* * * * *